US006039214A

United States Patent [19]

Hewett

[11] Patent Number: 6,039,214

[45] Date of Patent: Mar. 21, 2000

[54] MATERIAL DISPENSING SYSTEM

[76] Inventor: Frank W. Hewett, 17535 Noll Rd. NE., Poulsbo, Wash. 98370

[21] Appl. No.: 09/161,024

[22] Filed: Sep. 25, 1998

Related U.S. Application Data

[60] Provisional application No. 60/060,439, Sep. 30, 1997.

[51] Int. Cl.[7] ..... B65D 35/24

[52] U.S. Cl. ..... 222/93; 222/105; 222/181.2

[58] Field of Search ..... 222/93, 105, 181.2, 222/108, 192, 148, 517

[56] References Cited

U.S. PATENT DOCUMENTS

| | | | |
|---|---|---|---|
| 5,050,775 | 9/1991 | Marquardt | 222/93 |
| 5,333,757 | 8/1994 | Volk et al. | 222/105 |
| 5,341,959 | 8/1994 | Ellis | 222/105 |

*Primary Examiner*—Philippe Derakshani

*Attorney, Agent, or Firm*—Donna J. Thies

[57] ABSTRACT

A multi-functional material dispensing system comprising in general a container, a discharge unit for discharging material and a support frame to hold the container and discharge unit upright. The container and discharge unit are removably attached to the support frame. A disposable filling device, in the form of a flexible funnel, is removably attached to the container. Flow control is metered through the discharge unit by opening a clamping device varied amounts. A gripper allows the container to be closed when the container is not on the support frame. An auxiliary support is also provided having a holder for the filling device, a cleaning unit, a holder for the cleaning unit and holders for various accessories for the system. A horizontal platform is removably attached to the support frame for holding accessories to the system and for catching material spills. Content tags can also be removably attached to the system and to supplementary storage areas. A method of dispensing material is also disclosed.

20 Claims, 7 Drawing Sheets

MATERIAL DISPENSING SYSTEM

This application claims the benefit of U.S. Provisional No. 60/060,439 filed Sep. 30, 1997.

BACKGROUND OF THE INVENTION

1. Field of the Invention

The present invention relates generally to dispensers, and more particularly, to material dispensing systems.

2. General Background

There are many materials for which it is desirable to have a dispensing system. In general, these commodities can include, among other things, dry cooking ingredients used in a restaurant, other dry ingredients used in any application where similar ingredients are used often, and liquid materials.

Liquids such as paints, cleaners, and solvents are often used in small quantities (usually less than one pint). These liquids are typically volatile or contain volatile solvents and tend to have a short shelf life after the container is opened. The standard method for storing these and other liquids is in a sealed container, the typical container being a metal paint can with a removable lid or threaded cap. When opened to remove small amounts of the liquid contents, these containers allow air to enter and interact with the volatile portions of the contents. Consequently each opening of the container reduces the shelf life of the paint, cleaner, or solvent.

Accordingly, there exists a need for a material dispenser that can dispense small amounts of a material without allowing air to interact with the volatile components of the material.

SUMMARY OF THE INVENTION

The present invention has solved the problems cited above, and comprises broadly of a material dispensing system that prevents the introduction of air into the storage container. There is a containing means comprising at least one bag; a material dispensing means comprising at least one opening in the bag; and a support means in the form of a support frame. The support frame holds at least one bag in a relativity fixed relationship with at least one material dispensing means. The support frame and material dispensing means typically also allow the bag to be easily removed for storage if desired.

In its preferred embodiment, the material dispensing system also includes a flow control means for metering the flow of material from the material dispensing means. Also, in its preferred embodiment, the material dispensing system includes an attaching means in the form of a sleeve positioned on top of the bag for attaching the bag to the support frame. The material dispensing system also preferably includes a filling means in the form of a flexible funnel that is removably attached to the bottom of the bag. When the bag is filled, the filling means is removed, leaving the containing means with the material dispensing means positioned at the bottom of the bag.

Also, in its preferred embodiment; the material dispenser system includes an auxiliary support means that allows the bag to be filled on an auxiliary support and holds a cleaning means for cleaning the various parts of the system.

It is therefore an object and advantage of the present invention to provide a material dispensing system that allows materials to be stored and dispensed without interaction with ambient air.

It is another object and advantage of the present invention to provide a convenient and easy means for filling the material dispensing system.

It is yet another object and advantage of the present invention to provide a material dispensing system that allows controlled amounts of material to be dispensed.

It is still yet another object and advantage of the present invention to provide a material dispensing system that includes a means for cleaning the system.

It is still yet another object and advantage of the present invention to provide a material dispensing system that is convenient and easy to use for dispensing and storing materials.

It is still yet another object and advantage of the present invention to provide a material dispensing system that has everything necessary for the user in a single, self-contained area.

It is still yet another object and advantage of the present invention to provide a material dispensing system that is simple and inexpensive in its manufacture.

These and other objects and advantages of the present invention will become apparent with a thorough review of the following specification and claims.

BRIEF DESCRIPTION OF THE DRAWINGS

FIGS. 5A and B show how the filling means of the present invention is used and show the bottle holder of the cleaning means.

DESCRIPTION OF THE PREFERRED EMBODIMENT

Description

Figure 1:
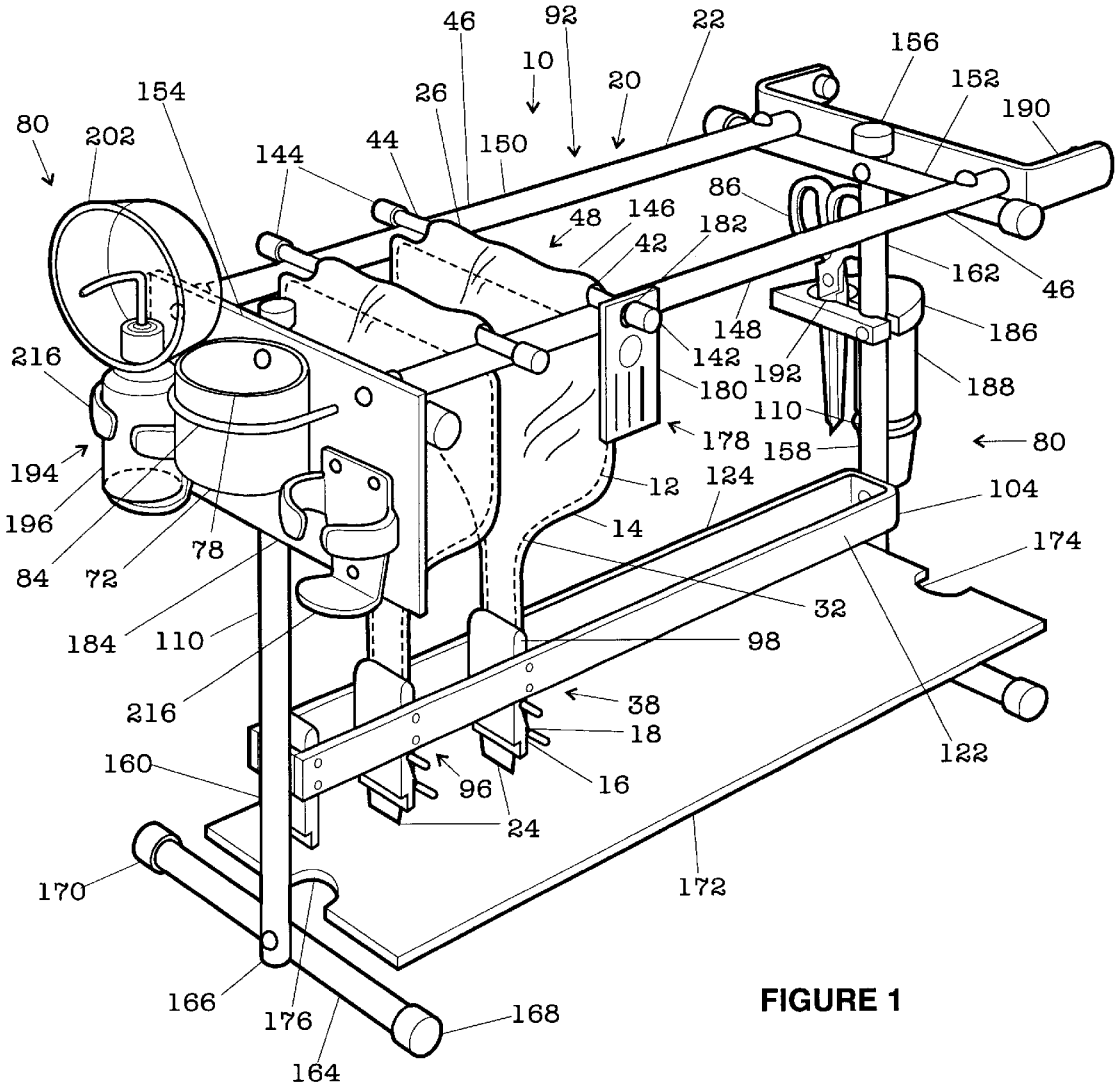
FIG. 1 is a perspective view of a multi-bag embodiment of the present invention showing a first auxiliary filling and cleaning support frame and a second auxiliary accessory support frame.

FIG. 1 illustrates a multi-bag material dispensing system in accordance with the present invention. The embodiment as shown in FIG. 1 is intended for applications where several different materials, specifically liquids are in use, for example, in a sign shop with a different color of paint in each bag. The material dispensing system of the present invention is shown generally by the number 10. The material dispensing system 10 generally comprises a containing means 12 in the form of at least one bag 14, a material discharge means 16 in the form of at least one opening 18 in the bag 14, and a support means 20 in the form of a support frame 22.

In its broadest configuration, the material dispensing system 10 of the present invention comprises a containing means 12 for containing a material. A material discharge means 16 is positioned at the bottom 24 of the containing means 12 for dispensing the material, and a support means 20 supports the containing means 12 and the material discharge means 16 in an upright position from top to bottom.

Generally, the containing means 12 is in the form of at least one bag 14 and contains the material dispensed by the multi-bag material dispensing system 10. The bag 14 is formed from two layers of a flexible material that will not be damaged or degraded by contact with the material to be contained therein. The two layers of flexible material that form the bag are bonded together along a bond line 26 and a support bond 28, as seen most clearly in FIG. 3. Typically, the bag 14 is formed from PVC plastic and the two layers are sealed together using heat, RF, or ultra sonic methods along the bond line 26 and the support bond 28. The bag 14 typically comprises a combination containing means and material discharge means. The material discharge means 16 partially includes a single opening 18 located at the bottom 30 of the neck 32 of the bag 14 as seen most clearly also in FIG. 3. In some embodiments, there may be a second resealable closure in the containing means 12. The opening 18 allows material to enter or leave the bag 14. The neck 32 is sized to easily slide between the long ends 34 of a spring 36 of a flow control means 38 as will be described hereinafter, and seen most clearly in FIG. 2. Metering of the material discharged is controlled by the flow control means 38.

Figures 3, 4:
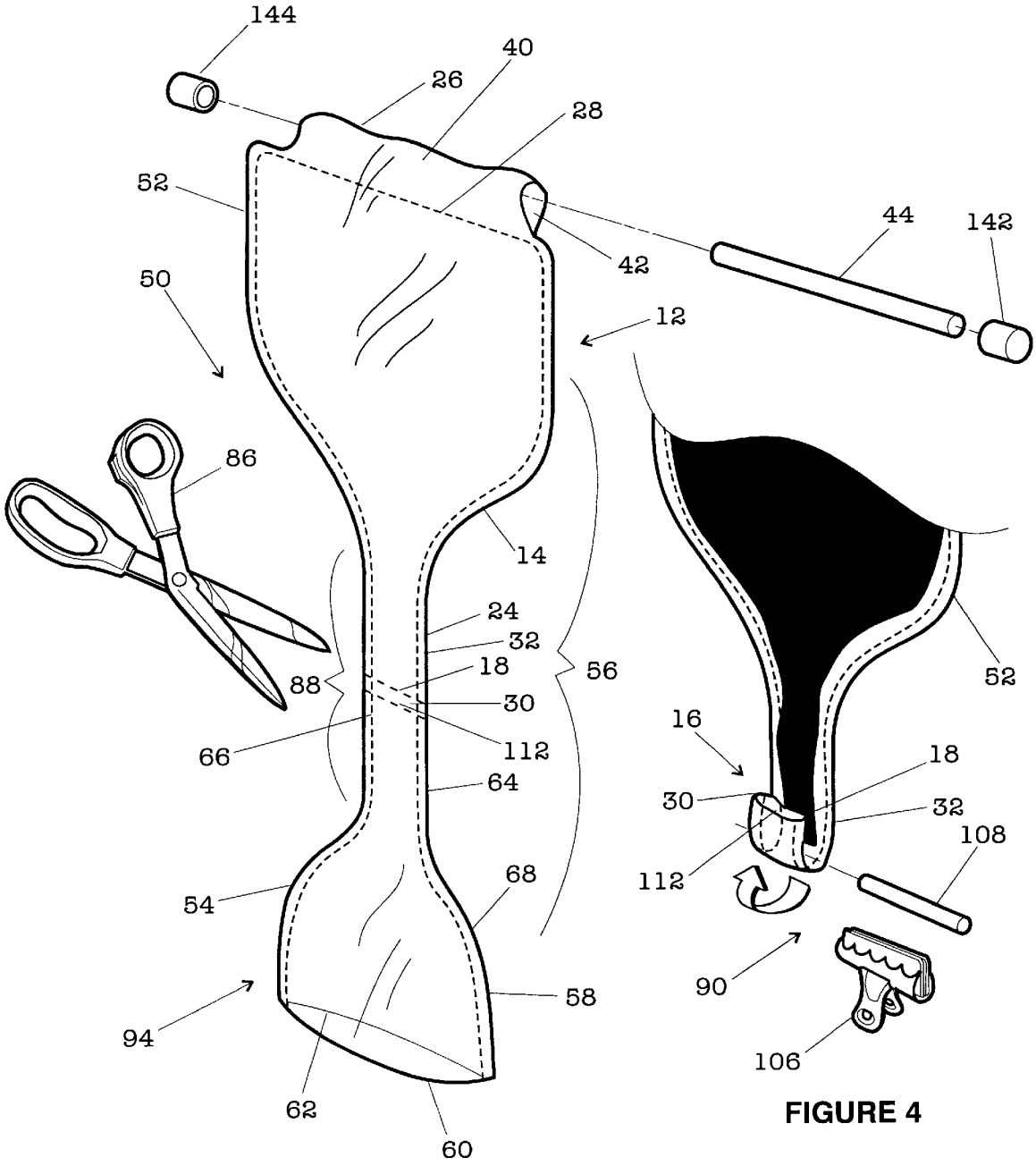
FIG. 3 is an isometric view of a combination containing means and filling means of the material dispensing system.
FIG. 4 is a perspective view of the containing means of the present material dispensing system showing a gripping means to hold closed the bottom of the containing means.

As seen most clearly in FIG. 3, a support section 40 of the bag 14 lies between the bond line 26 and the support bond 28. The support section 40 has at least one "U" shaped sleeve 42 in the upper edge of the bag 14. A rod 44 is positioned through the sleeve 42 formed between the bond line 26 and the support bond 28. The bag 14 is supported on a horizontal support 46 on the support frame 22 by the rod 44, as seen most clearly in FIG. 1. The rod 44 must have sufficient strength to support the weight of the bag 14 when the bag 14 is completely filled. The rod 44 can be formed from any reasonably smooth and strong material, typically wood or plastic. In the preferred embodiment, after the rod 44 is positioned through the sleeve 42, the rod 44 is positioned atop two horizontal supports 46 on the support frame 22 to hold the bag 14 in an upright position from top to bottom. In the preferred embodiment, the rod 44 and the sleeve 42 in the bag 14 comprise the attaching means 48 for attaching the containing means 12 and the material discharge means 16 to the support means 20, also as seen most clearly in FIG. 1.

Figure 2:
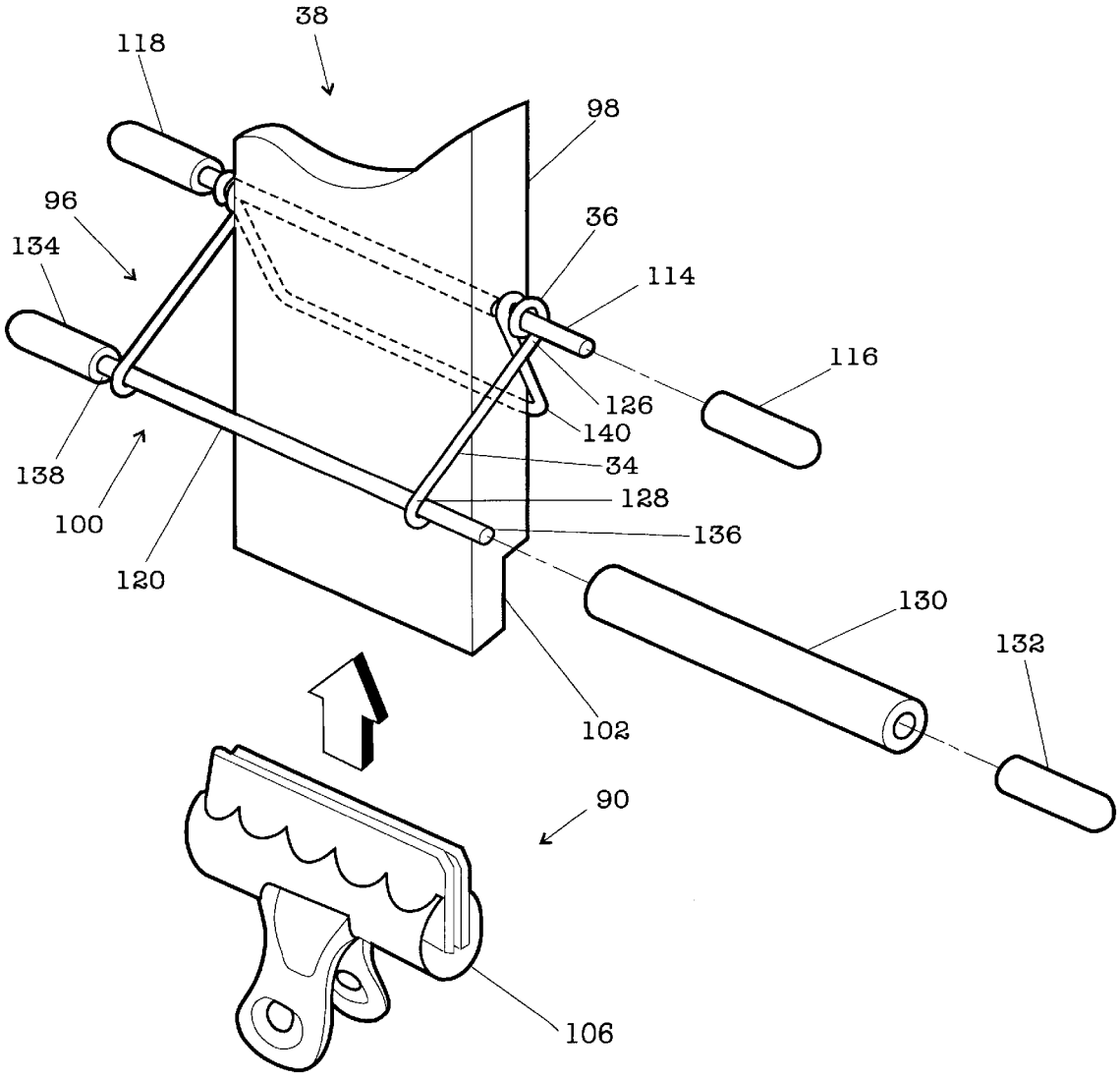
FIG. 2 is a front view of the flow control means for the present material dispensing system, showing a gripping means used when the system and containing means of the system, is transported.
Figure 5A:
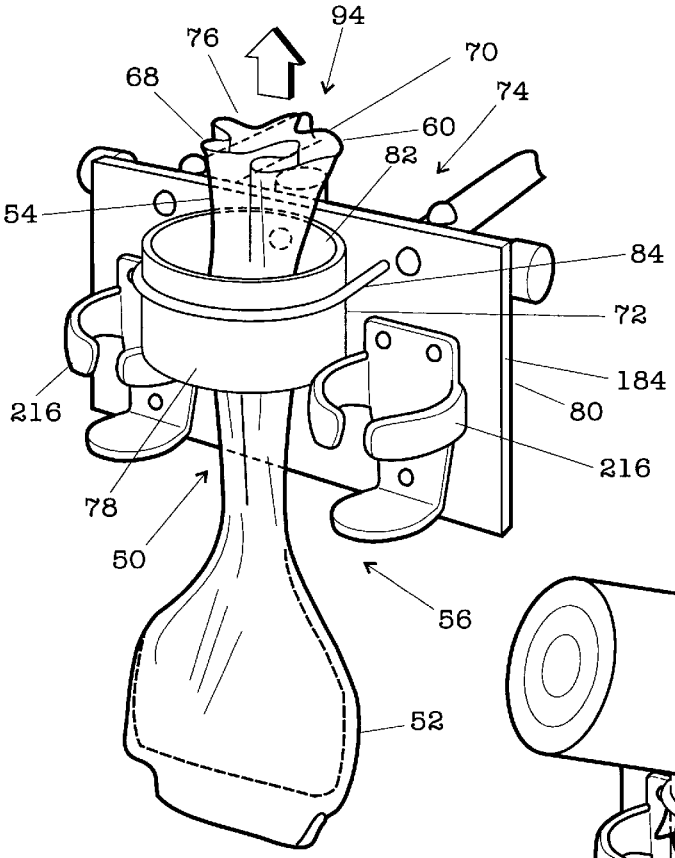
FIGS. 5A and 5B are perspective views of the first auxiliary filling and cleaning support frame, as enlarged and as shown also in FIG. 1.
Figure 5B:
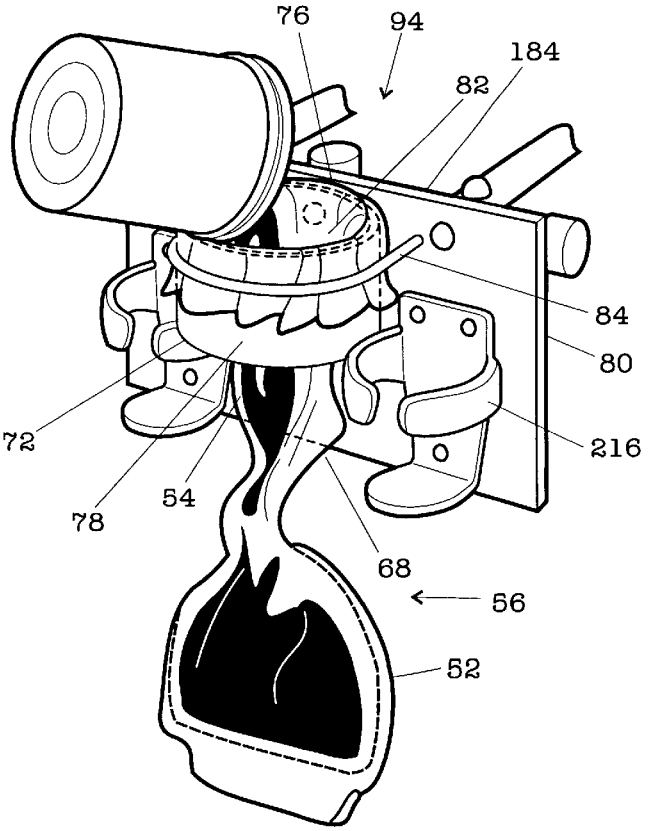

In the preferred embodiment of the present invention, the containing means 12 which is a combination containing means and material dispensing means is also a combination containing and filling means 50 as shown in FIG. 3, comprising, in general, a bag 14 having a containing portion 52 and a filling portion 54 forming a combination containing and filling means unit 56, the containing portion 52 of the bag 14 being removably attached to the filling portion 54 of the bag 14. The filling portion 54 of the bag 14 is formed of the same material as the containing portion 52 and generally comprises a flexible, funnel shaped appendix 58 to the containing portion 52. The filling portion 54 of the bag 14 has a wide, upper cone shaped opening 60 at its bottom 62 and a narrower tube shaped portion 64 at its top 66. The narrower tube shaped portion 64 at the top 66 of the filling portion 54 is associated with the mating opening 18 in the neck 32 at the bottom 24 of the containing portion 52 of the bag 14. In operation, the combination containing and filling means unit 56 is turned upside down, so that the flexible funnel 68 or wide upper cone shaped opening 60 at the bottom 62 of the filling portion 54 is at the top 70 of the unit 56 as seen in FIGS. 5A and 5B. After filling the bag 14, the filling portion 54 and the containing portion 52 are separated and the mating opening 18 in the neck 32 at the bottom 24 of the containing portion 52 of the bag 14 becomes part of the material dispensing means 16. To fill the combination containing and filling means 50, the bottom cone shaped opening 60 in the filling portion 54 is slipped up into a cylindrical member 72 on the filling device 74, as seen most clearly in FIGS. 5A and 5B, and then the top 76 of the cone shaped opening 60 is turned over the periphery 78 of the cylindrical member 72 on the auxiliary support means 80, as will be described hereinafter, and as shown also in FIG. 1. The bottom cone shaped opening 60 is positioned up into and down around the cylindrical member 72 such that the cone shaped opening 60 uses the center opening 82 of the cylindrical member 72 for pouring material therethrough. The flexible cone shaped opening 60 of the filling portion 54 of the bag 14 is secured to the outside periphery 78 of the cylindrical member 72 by means of a stretchable cording 84 or other suitable means, as seen also in FIG. 5B. As liquid is poured into the filling portion 54 of the bag 14, through the opening 82 in the cylindrical member 72 it moves downward through the filling portion 54 of the bag 14, through the opening 18 in the containing portion 52 of the bag 14 and into the containing means 12. After the material has moved from the filling portion 54 of the bag 14 into the containing portion 52, the filling portion 54 is detached from the containing portion 52, as seen in FIG. 3, by cutting through the plastic with a scissors 86 anywhere along the neck portion 88 between the filling portion 54 and the containing portion 52, such that the material is entirely in the containing portion 52. The containing portion 52 of the bag 14 is then closed using the gripping means 90; as shown in FIGS. 2 and 4 and as will be described hereinafter, and moved to the main portion 92 of the support frame 22, as seen in FIG. 1. The disposable filling portion 54 is then discarded. In its broadest configuration, the filling means 94 comprises only the filling portion 54 of the bag 14, since the filling portion 54 of the bag 14 can be used in many ways to fill the containing portion 52 of the bag. In the preferred embodiment of the present invention, however, the filling means 94 comprises the filling portion 54 of the bag 14, the cylindrical member 72, and the stretchable cording 84 positioned on the auxiliary support means 80 as shown in FIGS. 5A and 5B.

FIG. 2 is a front view of the flow control means 38 of the present invention showing also the gripping means 90 used when the system 10, or containing means 12 of the system is transported. In its broadest configuration, the flow control means 38 comprises a clamping means 96 and a back support 98 for the clamping means 96. In general, the flow control means 38 meters the flow of material out of the bag 14, in that the more the clamp 100 of the clamping means 96 is released, the more material comes out of the bag 14, providing a selected rate of flow of material, rather than a strictly open or closed condition. In the preferred embodiment, the flow control means 38 comprises the clamping means 96 having a clamp 100, and springs 36 for clamping shut the neck 32 of the bag 14, removably attached to the back support 98, as seen in FIG. 1 and in more detail in FIG. 2.

The clamping means 96 generally comprises the clamp 100 which engages the bottom indented portion 102 of the back support 98 of the flow control board 104 whereby the neck 32 of the bag 14 is wrapped around the indented portion 102 of the back support 98 and the clamp 100 is clamped around the indented portion 102 of the back support 98 to ensure a tight, yet removable, closure of the neck 32 of the bag 14 when the main support frame 22 is standing upright. Additionally, in the preferred embodiment, the supplemental gripping means 90, including a gripper 106 and rod 108 is provided, in the event that it is desirable to lay the material dispensing system 10 on it's side for storage or travel purposes. In this event, the neck 32 of the bag 14 is removed from the back support 98 of the flow control means 38, the dry end of the neck 32 of the bag 14 is wrapped around the rod 108, and the rod 108 is gripped with the gripper 106 being positioned around the rod 108, as seen in FIG. 4.

Figure 8:
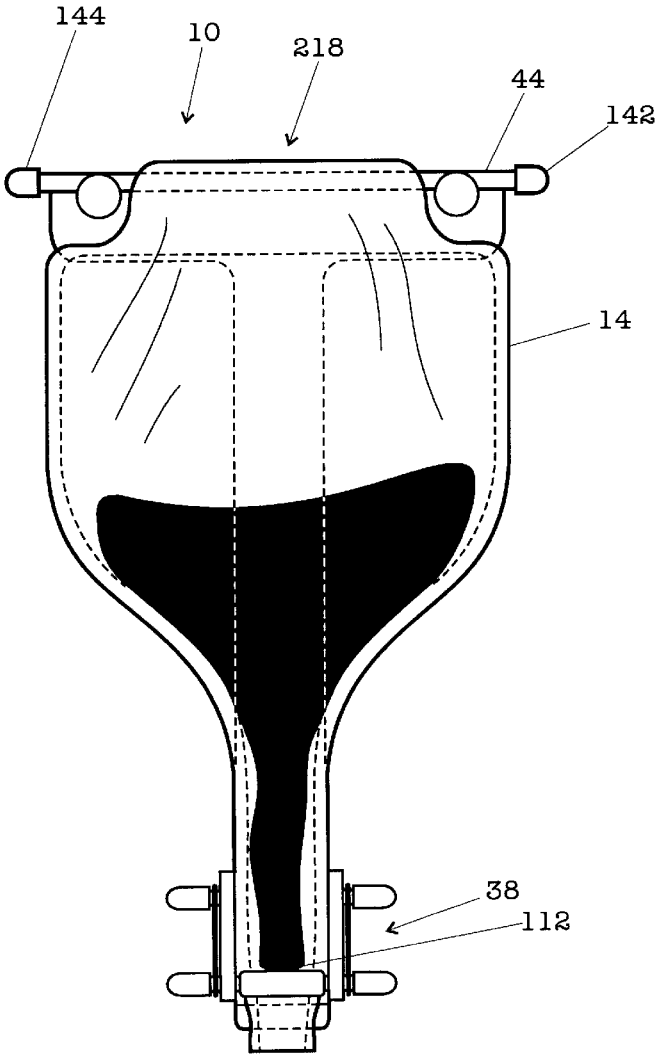
FIG. 8 is a front view of a single bag embodiment of the present material dispensing system.

So, the flow control means 38 generally comprises the clamping means 96 to close together the opening 18 in the bag 14. As part of the clamping means 96, the flow control board 104 is attached to a vertical support 110 on the support frame 22, as seen in FIG. 1. Attached to the flow control board 104 is at least one back support 98, having removably attached thereto a spring clamp member or clamp 100. In operation, the neck 32 and opening 18 in the bag 14 are positioned down along the back support 98, the spring clamp 100 engages the bottom 112 of the opening 18 in the bag 14 and the portion of the neck 32 of the bag 14 that is empty is secured with the clamp 100 which squeezes the neck 32 to closure as seen in FIGS. 1, 3, and 8.

The flow control means 38, partially including the flow control board 104, as seen in FIG. 1, is fastened to a vertical support 110 a fixed distance below the bag 140. This distance will vary depending on the length and size of the bag 14. The bag 14 will preferably have two to three inches extending below the flow control board 104. This distance should allow the bag 14 to be sealed and the bag 14 removed from the multi-bag material dispensing system 10 for storage or disposal. Each bag 14 should have a corresponding flow control means 38 that will control the flow of liquid from the bag 14. In the preferred embodiment, the flow control means 38 includes at least one flow control board 104. Each flow control board 104 comprises a back support 98; a pin 114; caps 116 and 118; a stem 120; and a spring 36, as seen in FIG. 2. The back support 98 is the main support structure for the flow control means 38. The back support 98 is mounted to the side members 122 and 124 of the flow control board 104, which are part of the main support frame 22, as seen in FIG. 1, by gluing, fastening, welding, or comparable method compatible with the materials selected for the sides 122 and 124, and the back support 98. The preferred material for the back support 98 is a tough, easy-to-form plastic, such as nylon or PVC. The preferred material for the sides 122 and 124 is aluminum. The preferred method for mounting the sides 122 and 124 on the support frame 22 to the back support 98 is with rivets or screws.

As seen in FIG. 2, the back support 98 has an opening sized to allow a pin 114 to pass therethrough. The pin 114 will also pass through openings 126 in the spring 36 and the pin 114 is capped by caps 116 and 118 to retain the spring 36 on the pin 114. The spring 36 is proximate to the back support 98. The pin 114 is preferably made from steel, however, any material having sufficient strength and toughness would be suitable. At the portion 128 of the long ends 34 distal to the pin 114, the long end 34 engages the stem 120. The stem 120 is covered by a cylinder 130 of plastic or rubber and capped with caps 132 and 134 at each end 136 and 138, in a manner similar to the manner in which the pin 114 is capped. The caps 132 and 134 for the stem 120 retain the stem 120 onto the long ends 34 of the spring 36. Preferably, there will be equal amounts of capped stem 120 projecting beyond the long ends 34 of the spring 36. These projecting tips 132 and 134 serve as operating handles for the flow control means 38. The stem 120 can be manufactured from any tough and durable material, preferably, aluminum, nylon or PVC plastic. The spring 36 has long ends 34 and a back section 140. The long ends 34 rest against the stem 120 and the back section 140 rests against the back support 98. The spring 36 provides sufficient force to hold the stem 120 firmly against the back support 98. However, the spring force must not be so great that a person can not pull the stem 120 away from the back support 98. Typically, the spring 36 will be formed from spring steel. Other materials that can provide a similar closing force could be easily substituted. The spring 36 preferably is manufactured as a single piece for ease of assembly.

As seen in FIG. 1, the support means 20 in the form of a support frame 22, can be of almost any configuration that provides at least one horizontal support 46. The horizontal support 46 must have sufficient strength to carry the weight of the number of bags 14 selected for a particular application. This weight should be taken with the bag 14 filled to it's maximum capacity. Additionally, the horizontal support 46 should have adequate rigidity to minimize the bending or sagging of the horizontal support 46. If the horizontal support 46 bends an excessive amount, the bags 14 may slide on the horizontal support 46 to a low point caused by the weight of the bags 14 filled with material.

In the preferred embodiment of the present invention, there is also provided an attaching means 48, as seen in FIG. 1, for removably attaching the containing means 12 and the flow control means 38 to the support means 20 for easy and convenient storage and dispensing of a material. In the preferred embodiment, the attaching means 48 comprises the rod 44 having two capped ends 142 and 144, adapted to fit atop the two horizontal support members 46, as seen in FIG. 1. A sleeve 42 in the top 146 of the containing means 12 slips over the rod 44 so that the containing means 12 is held upright under the rod 44, as described hereinbefore. The horizontal support members 46 are positioned above the flow control board 104 to hold the containing means 12 upright between the horizontal support members 46 and the flow control board 104. The material discharge means 16 of the bag 14 then, is held proximate to the flow control board 104 for controlled dispensing of the material as will be described in greater detail hereinafter.

The horizontal support 46, preferably has a first horizontal support 148 and a second horizontal support 150. The use of horizontal supports 148 and 150 spreads the weight of the bag 14 allowing the use of smaller and/or lighter materials. Additionally, the use of more than one horizontal support 46 reduces the swinging or rotation of the bag 14 around the horizontal support 46 when the material dispensing system 10 is bumped during normal shop use.

When more than one horizontal support 46 is used to spread the load of bags 14 and to prevent the bags 14 from swinging, at least one spacer bar 152 is used to maintain the horizontal supports 148 and 150 a fixed distance apart. Longer length horizontal supports 46 will require the use of two or more spacer bars 152. The embodiment shown uses two spacer bars 152 and 154. The spacer bars 152 and 154 may be joined to the horizontal supports 148 and 150 by any method suitable for the materials selected for the horizontal support 46 and the spacer bars 152 and 154. These methods include welding, gluing, or fastening.

A vertical support 110 is joined at it's upper end 156 to either the horizontal support 46 or the spacer bar 152, whichever is more convenient to manufacture. The vertical support 110 may be joined to the horizontal supports 46 or to the spacer bar 152 by any method suitable for the materials selected for the horizontal support 46, the spacer bars 152, or the vertical support 110. These methods include welding, gluing, or fastening. The vertical support 110 maintains the bag(s) 14 at a fixed height above the flow control board 104. Additionally, the vertical support 110 will set the height of the bag(s) 14 and the flow control back supports 98 above the ground or work surface. Preferably, the height of the flow control board 104 is set at a comfortable working height for the user. The vertical support 110 may be formed from a single piece or may be formed from multiple pieces. The embodiment show in FIG. 1 uses two vertical supports 158 and 160. Each vertical support 158 and 160 is joined to a spacer bar 152 at the vertical support upper end 162 and is joined to a support bar 164 at the vertical support lower end 166. These joints are formed in a similar fashion to the joints described above. Preferably, each support bar 164 at the vertical support lower end 166 will have two capped ends 168 and 170 that act as feet to support the frame 22 on a work surface such as a table or bench. A horizontal platform 172 having notches 174 and 176 adapted to fit around the vertical support 158 and 160 at the vertical support lower end 166 also is helpful if it is desirable to hang the support frame 22 on a wall. The horizontal platform 172 in this instance would be convenient for placing cleaners, paint cans or other items used. The horizontal platform 172 also functions as a drip tray whether the system 10 is placed on a work surface or hung on a wall.

In the preferred embodiment, the main support frame 92 carries identifying means 178 in the form of content tags 180, removably attached to the support rods 44 in proximity to an individual bag 14 as seen in FIG. 1 The content tag 180 has a hole 182 adapted to fit over the capped end 142 of a rod 44 on the support frame 22 for identifying the contents of the bag 14, for example, the color of paint within. For storage purposes, a mating protuberance for the hole 182 can be positioned inside or outside a cabinet or the like so that the content tag 180 can be moved with the bag 14 when the bag 14 is not on the support frame 22.

In the preferred embodiment, an auxiliary support means 80 is also provided. In the preferred embodiment, the auxiliary support means 80 is in the form of a first 184 and second 186 auxiliary support frame rigidly attached to the main support frame 92. The auxiliary support means 80 carries a cup dispenser 188 a paper towel rack 190, scissors holder 192 and can easily include any other attachment that would be useful in the material dispensing system 10. A cleaning means 194, as seen in FIG. 6, and the filling device 74, as seen in FIGS. 5A and 5B, are also provided on the auxiliary support means 80.

Figure 7:
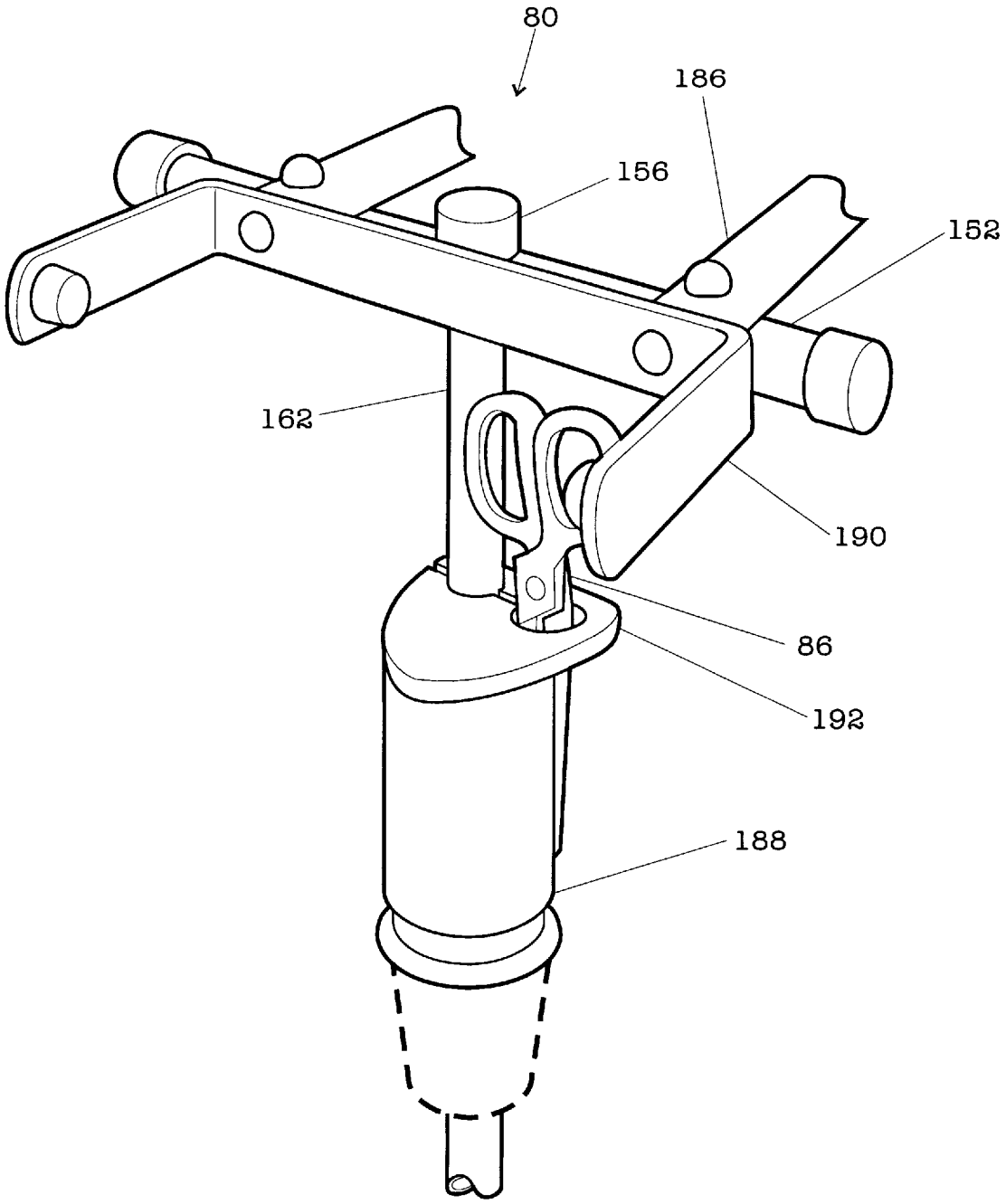
FIG. 7 is a perspective view of the second auxiliary accessory support frame, enlarged and as shown in phantom in FIG. 1.

The filling device 74, as seen in FIGS. 5A and 5B, in part, comprises the cylindrical member 72 that the filling portion 54 of the bag 14 is slipped up into and over in order to easily fill the bag 14 as described hereinbefore. In the preferred embodiment, the filling device 74 and the cleaning means 194 are positioned on the first auxiliary support frame 184, as seen in FIGS. 1 and 5 and other accessories are positioned on the second auxiliary support frame 186, as seen in FIGS. 1 and 7. It is within the spirit and scope of the invention, however to position the filling device 74, cleaning means 194, and other accessories in any convenient location, including a separate support frame that is not attached to the main support frame 92.

Figure 6:
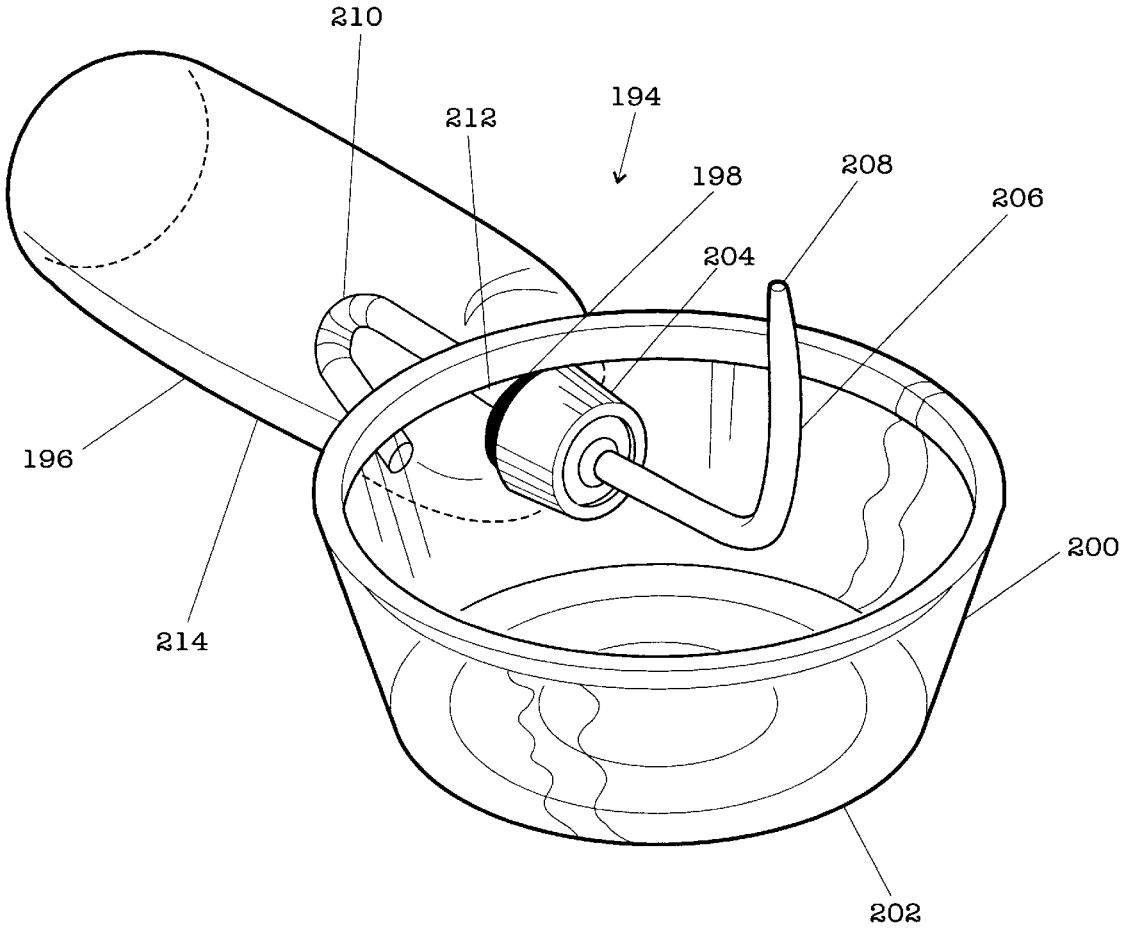
FIG. 6 is a perspective view of the cleaning means of the first auxiliary support frames.

The cleaning means 194, as seen in FIG. 6, associated with the material dispensing system 10 is also provided on the first auxiliary support frame 184. The cleaning means 194, comprises a squeeze type bottle 196 having its top opening 198 positioned through the side 200 of a disposable bowl 202. Inside the disposable bowl 202 the bottle 196 is capped off with a cap 204 having a generally "l"-shaped tube 206 arrangement as bottles typically used in Chemistry labs. In operation, the open end 208 of the "l"-shaped tube 206 is inserted into any tubing or other portion of the system which it is desirable to have cleaned. Therefore, if water based paint is used, water is placed in the bottle 196, the "l"-shaped tube 206 is inserted into an area to be cleaned, the bottle 196 is squeezed; water comes out of the tube 206 and rinses the area to be cleaned. Paint thinner, or other chemical can also be used in the bottle 196 as appropriate. The rinsed paint then drains into the disposable bowl 202. Thus, a convenient and efficient cleaning of the system and parts is accomplished. In the preferred embodiment, a flexible straw 210 or similar tubing is attached to the end 212 of the "l"-shaped tube that is within the bottle 196. Thus, as the bottle 196 is on its side during cleaning, the flexible straw 210 serves to reach into the bottom 214 of the bottle 196 so that all remaining water or other cleaner is squeezed out of the bottle 196, as seen in FIG. 6. When the cleaning means 194 is not being used, it can be conveniently positioned in the bottle holder 216 on the first auxiliary support frame 184, as seen in FIG. 1.

Figure 9:
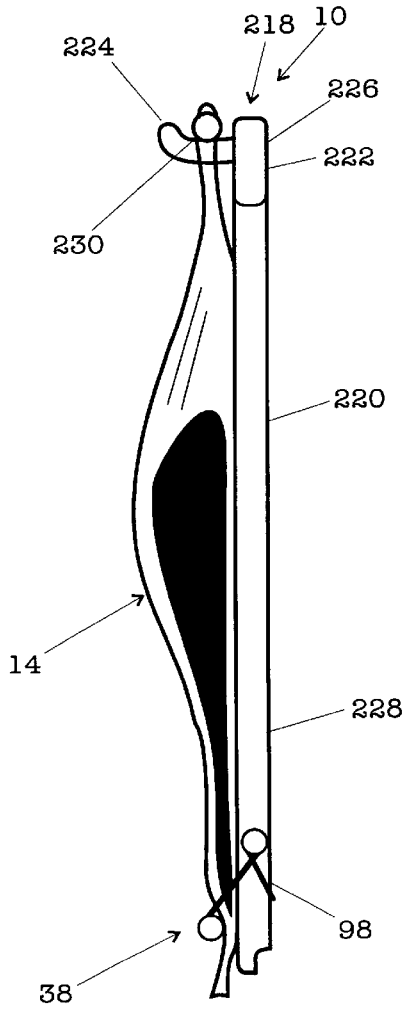
FIG. 9 is a side view of a single bag embodiment of the present material dispensing system.

FIGS. 8 and 9 also illustrate a single bag embodiment of the material dispensing system 10. The single bag material dispensing system 218 comprises a support back 220, a single flow control means 38, and a bag 14. The bag 14 is the same as that described above. The support back 220 can be of almost any size or shape. The preferred shapes are either a "T" as shown or the shape of an empty bag 14. The support back 220 has a frame 222 and hooks 224. The frame 222 has an upper "T" end 226 and a lower flow control end 228. The upper "T" end 226 has at least one hook 224. Preferably, there will be two hooks 224 to support the bag 14. The use of two hooks 224 spreads the weight of the bag 14, allowing the use of smaller and/or lighter materials.

Additionally, the use of more than one hook 224 reduces the swinging or rotation of the bag 14 around the hook 224 when the single bag material dispensing system 218 is bumped during normal shop use. If the bag 14 swings or rotates an excessive amount, then the bag 14 may spill into the work area. Hook(s) 224 is(are) joined to the upper "T" end 226 by bonding, fastening, welding, or being molded as a single unit with a frame 222. The preferred method is by molding the frame 222 and hooks 224 as a single unit. Additionally, in some applications the support back 220 may have two or more pieces. If two pieces are used there would be an upper portion with hooks 224 and a lower portion with the single flow control means 38. When the support back 220 is formed in two pieces, care must be taken to mount the flow control means 38 in the proper location, so that the single flow control means 38 is centered below the bag 14 at the proper distance below the hooks 224.

The single flow control means 38, in FIGS. 8 and 9, is similar to the flow control means 38 shown in FIG. 1 with the following differences: 1) there are no sides 122 and 124 (FIG. 1), and 2) the back support 98 (FIG. 1) is replaced with the lower flow control end 228 of the support back 220.

Use

Both the multi-bag material dispensing system 10 and the single bag material dispensing system 218 function in a similar fashion, the main difference being the containing means 12 or number of bags 14 in use at a time. First, the bag 14 is filled using the filling means 94 as described above. Second, the bag 14 is installed on the support frame 22 or on the support back 220. The bag 14 is installed on the support frame 22 by placing the rod 44 onto the horizontal supports 46. The rod 44 having previously been inserted between the two layers of material forming the sleeve 42 in the bag 14 and between the support bond 28 and horizontal supports 46. Thus, the rod 44 will rest on top of the horizontal supports 46 and the weight of the bag 14 will be carried by the support bond 28 being supported by the rod 44. Alternatively, the bag 14 is installed on the support back 220 by placing the hooks 224 into cutouts 230 in place of the horizontal supports 46 described above. The rod 44 is then inserted between the two layers of material forming the bag 14 and between the support bond 28 and hooks 224. Thus, the rod 44 will rest on top of the hooks 224 and the weight of bag 14 will be carried by the support bond 28 being supported by the rod 44.

Next, the bag 14 is filled with the desired material, if the bag 14 has not been already filled using the filling means 94 as described above. An easy method is to insert a funnel into the opening 18 in the bag 14 and secure the neck 32 to the funnel with tape, a rubber band, or similar device. Then, raise the funnel and neck 32 above the containing portion 52 and pour the desired quantity of fluid into the funnel. Next, remove the funnel from the opening 18 and remove any excess air from the bag 14 by gently squeezing the containing portion 52 of the bag 14. After the excess air has bled off, fold the neck 32 at least once and seal with a gripper 106 the same width as the neck 32. Alternatively, a disposable funnel may be made from a short length of hose and a length of large diameter plastic tubing. The outside diameter of the hose must be smaller than the inside diameter of the neck 32. The inside diameter of the plastic tubing must be large enough to fit around the container from which the fluid is taken. Preferably, the plastic tubing should have a wall thickness similar to the plastic sheeting, typically 1–20 mils. A first end of the plastic tubing is inserted through the hose, then doubled back over the hose, and finally taped to the exterior of the hose. The hose with plastic tubing attached is inserted into the opening 18 and attached in a similar fashion as the funnel described above. The container from which the fluid is to be taken is inserted into a second end of the plastic tubing, and the bag 14 filled as described above. After filling and sealing the bag 14, the sealed end of the neck 32 is inserted through the clamping means 96 of the flow control means 38. The stem 120 is lifted and the neck 32, opening 18, and the clamps 100 are slid between the stem 120 and the back support 98 or between the stem 120 and the lower end 228 of the support back 220. The stem 120 is released and is forced against either the back support 98 or the lower end 228 of the support back 220 by the spring 36 thereby sealing the bag 14. After removing the clamp 100, the material dispenser is ready for service. Lifting the stem 120 operates the material dispensing system 10 or 218 allowing material to flow from the opening 18 in the bag 14. After the desired amount of material has been discharged from the bag 14, the stem 120 is released and the spring 36 forces the stem 120 against the neck 32 and either the back support 98 or the support back 220 temporarily sealing the bag 14.

It can be seen from the foregoing that all the objects and advantages have been accomplished by the present material dispensing system 10. A containing means 12 has been provided that contains a material without allowing air to interact with the material. A material discharge means and a flow control means 38 have been provided that allows the material to be dispensed in controlled and small amounts. A support means 20 has been provided to support the containing means 12 and material discharge means 16 in an upright position. An auxiliary support means 80, including a first 184 and second auxiliary support frames 186, includes in part a filling means 94 and a cleaning means 194. The filling means 94 is provided for conveniently and easily filling the containing means 12. A cleaning means 194 is provided on the auxiliary support means 80 that allows everything the user needs to be in a compact, self-contained area.

A method of dispensing material is also disclosed whereby a containing means 12, material discharge means 16, flow control means 38 and support means 20 are provided. Auxiliary support means 80 is also provided, whereby the material dispensing system 10 functions as described hereinbefore. While there has been accomplished by the applicant's invention all of the objects and advantages of the invention, nevertheless, variation in the structure of the invention and the arrangement of the various parts are within the spirit and scope of the applicant's invention. The embodiments given have been given only by way of illustration and the applicant is not to be limited to the embodiment shown and described.

Having described my invention, I claim:

1. A material dispensing system comprising:

a container having a top and bottom;

a material discharge opening attached to the container;

a support frame removably attached to the container and the material discharge opening, the support frame supporting a plurality of containers.

2. The material discharge system as defined in claim 1 further comprising:

a flow control meter attached to the material discharge opening.

3. The material dispensing system as defined in claim 1 further comprising:

an attacher removably attached to the container, the material discharge opening and the support frame.

4. The material dispensing system as defined in claim 1 wherein the container is a combination container and filling apparatus.

5. A material dispensing system comprising:

containing means having a top and bottom, for containing a material;

material discharge means attached to the bottom of the containing means for dispensing material from the containing means;

support means removably attached to the containing and material discharge means for supporting the containing means and material discharge means in an upright position from top to bottom;

auxiliary support means fixedly attached to the support means for carrying accessories to the system; and whereby material dispensed from the containing means is removed from the containing means through the material discharge means.

6. The material dispensing system as defined in claim 5 wherein:

the auxiliary support means is removably attached to the support means.

7. The material dispensing system as defined in claim 5 further comprising:

a cleaning means removably attached to the auxiliary support means for cleaning the system.

8. The material dispensing system as defined in claim 5 further comprising:

filling means removably attached to the containing means, and a filling device removably attached to the auxiliary support means for supporting the filling means.

9. The material dispensing system as defined in claim 5 further comprising:

identifying means attached to the support means for identifying contents of the containing means.

10. The material dispensing system as defined in claim 1 further comprising:

an auxiliary support attached to the support frame.

11. The material dispensing system as defined in claim 1 further comprising:

a horizontal platform removably attached to the support frame for holding accessories to the system and catching material spills.

12. The material dispensing system as defined in claim 1 further comprising:

a gripper attached to the material discharge opening when the container is not attached to the support frame.

13. A method for dispensing material comprising the steps of:

providing a containing means having a top and bottom, for containing a material;

providing a material discharge means attached to the bottom of the containing means for dispensing material from the containing means;

providing a support means removably attached to the containing means and the material discharge means for supporting the containing means and the material discharge means in an upright position from top to bottom;

providing an auxiliary support means fixedly attached to the support means for carrying accessories to the system.

14. The method of dispensing material as defined in claim 13 wherein:

the auxiliary support means is removably attached to the support means.

15. The method of dispensing material as defined in claim 13 further comprising the step of:

providing a cleaning means removably attached to the auxiliary support means for cleaning the system.

16. The method of dispensing material as defined in claim 13 further comprising the step of:

providing a filling means removably attached to the containing means; and providing a filling device removably attached to the auxiliary support means for supporting the filling means.

17. The method of dispensing material as defined in claim 13 further comprising the step of:

providing a flow control means for metering flow of material from the material discharge means.

18. The method of dispensing material as defined in claim 13 further comprising the step of:

providing an attaching means for removably attaching the containing means and the material discharge means to the support means.

19. The method of dispensing material as defined in claim 13 further comprising the step of:

providing a filling means removably attached to the containing means.

20. The method of dispensing material as defined in claim 13 further comprising the step of:

providing a horizontal platform removably attached to the support means for holding accessories to the system and catching material spills.

* * * * *